United States Patent [19]

Petersen

[11] Patent Number: 4,509,664

[45] Date of Patent: Apr. 9, 1985

[54] PORTABLE SPRAYER WITH SAFETY COVER

[75] Inventor: Walter E. Petersen, Hastings, Minn.

[73] Assignee: H. D. Hudson Manufacturing Company, Chicago, Ill.

[21] Appl. No.: 478,027

[22] Filed: Mar. 23, 1983

[51] Int. Cl.[3] ..... B65D 83/14

[52] U.S. Cl. ..... 222/402

[58] Field of Search ..... 239/373; 222/397, 401, 222/402

[56] References Cited

U.S. PATENT DOCUMENTS 2,188,682 1/1940 Goetz ..... 222/402
2,769,580 11/1956 Hudson et al. ..... 222/402 X
3,091,372 5/1963 Tidd ..... 222/401
3,121,518 2/1964 Pinke ..... 222/402

*Primary Examiner*—Andres Kashnikow
*Attorney, Agent, or Firm*—Kane, Dalsimer Kane, Sullivan and Kurucz

[57] ABSTRACT

This invention pertains to a sprayer for insecticides. The sprayer consists of a tank and a cover assembly which includes an air pump for pressurizing the tank. The tank has a funnel-shaped neck which is engaged by the cover to form an air-tight enclosure. In order to insure that the cover does not separate suddenly when it is opened while the tank is still pressurized, the neck is provided with extrusions which do not permit the closure to separate from the tank as air is bleeding out of the tank.

4 Claims, 7 Drawing Figures

PORTABLE SPRAYER WITH SAFETY COVER

BACKGROUND OF THE INVENTION

1. Field of Invention

The present invention relates to portable sprayers and more particularly to compression sprayers for dispensing liquid insecticides and the like.

2. Description of the Prior Art

A number of compression sprayers are known in the art of the kind which have a cylindrical tank for holding a liquid and a cover for closing the tank, with a built-in air pump for pressuring the tank. A fexible nozzle is connected to the tank and has a manually activated shut-off valve for controlling the dispensing or spraying of the liquid from said tank. However these tanks have rather complicated constructions requiring difficult manufacturing methods. Furthermore the covers can be removed from the tanks while they are still pressurized causing an explosive separation between the tank and the cover and thus providing a source for possible injuries.

OBJECTIVES OF THE INVENTION

An abjective of this invention is to provide a portable sprayer with relatively simple-shaped elements for ease of manufacturing.

Another objective is to provide a sprayer with a cover which will not separate from the sprayer tank while it is being removed from a pressurized tank.

Other advantages and objectives of the invention shall become apparent in the preferred description.

SUMMARY OF THE INVENTION

The above-mentioned objectives are realized by a sprayer comprising a tank and cover assembly provided to form an air-tight closure with the tank. The cover assembly includes an air pump for pressurizing the tank. The tank has a funnel-shaped neck which ends in an upper flange. The flange has at least one cammed surface adapted to engage a notch of the cover as the cover is fastened to the tank. An extrusion on the cammed surface is provided to stop the cover from disengaging if it is removed while the tank is still pressurized. The cover is removable only after substantially all the air from the tank has escaped.

DESCRIPTION OF THE PREFERRED EMBODIMENT

Figure 1:
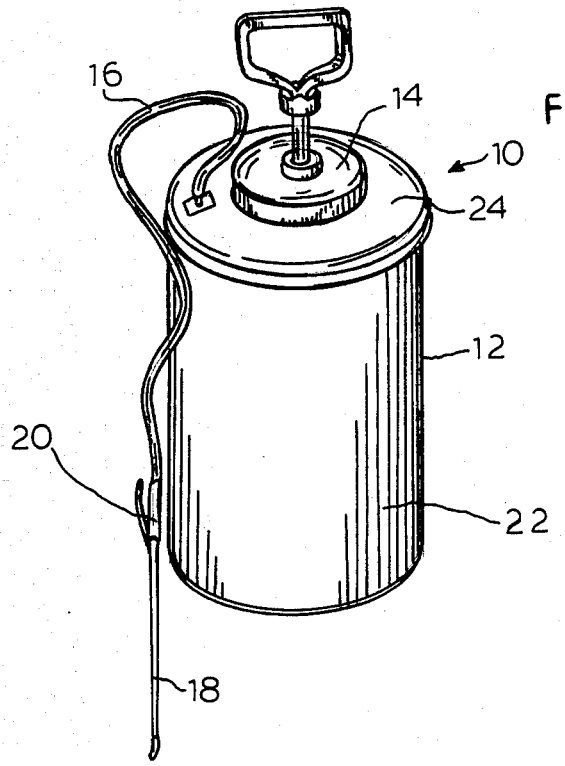
FIG. 1 shows a general view of the invention.
Figure 4:
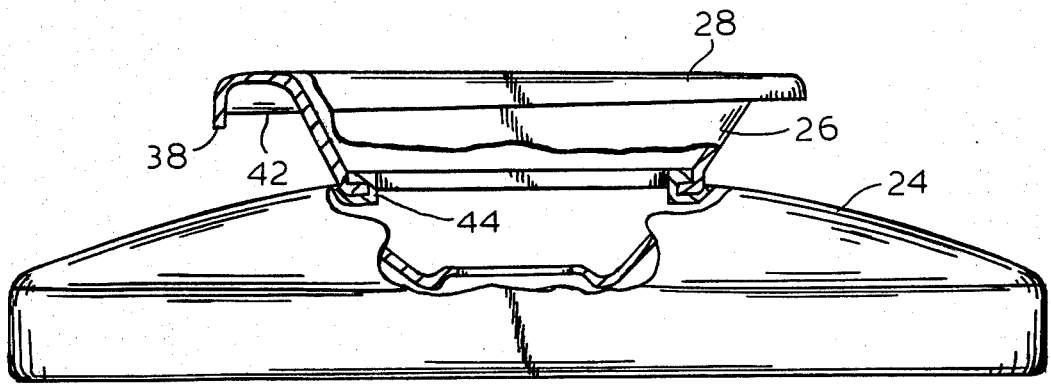
FIG. 4 is a cross-sectional view of FIG. 2.
Figure 2:
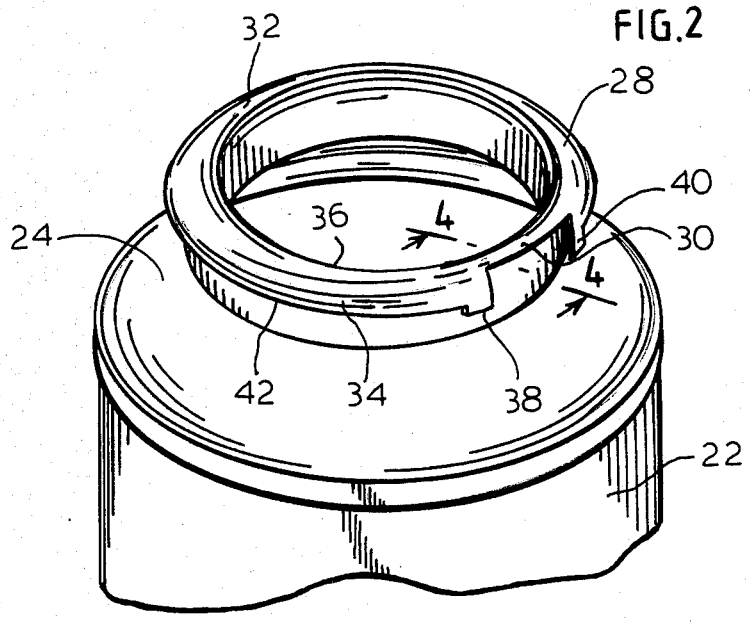
FIG. 2 shows details of the neck of the tank.

Referring to the FIGS., sprayer 10 comprises a tank 12 with a closure 14. Connected to the tank is a flexible hose 16 with a spray-nozzle 18 and shut-off valve 20. Tank 12 has a cylindrical sidewall 22 and top 24. The top has a centrally mounted funnel shaped neck 26 which flares outward as it rises upward from top 24 and terminates in a flat horizontal flange 28. As shown in FIG. 2, the flange is interrupted by two notches 30 and 32 which extend from the inner wall 36 of the funnel. Along its perimeter, between notches 30 and 32, the flange is extruded to form two cammed areas 34 and 36 oriented perpendicularly downward from said flange. Each of these cammed areas is bound circumferentially by an upper and a lower extension 38 and 40 located adjacent to said notches. Between these extensions the lower edge 42 of each cammed area rises slowly in the counterclockwise direction. Obviously extensions 38 and 40 are lower than said lower edge 42.

Funnel 26 is joined to top 24 so that a horizontal inner flange 44 is formed. The purpose of the funnel is to facilitate pouring liquids into tank 12.

Closure 14 comprises a generally conical member 46 which is complementary in shape and size to funnel 26. The member ends with a horizontal flange 48 on top. The flange 48 is terminated with a vertical skirt 50 extending downward from the flange. Two lips 52 are made in said skirt by making appropriate cuts therein and bending the skirt inward toward the funnel. The edge between the lips and the skirt is formed at an angle which conforms to the angle of edge 42.

Figure 3:
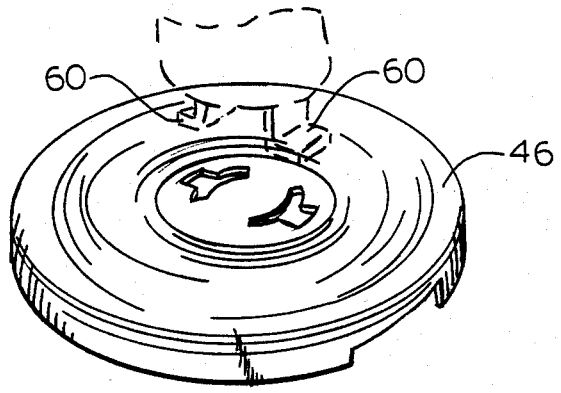
FIG. 3 shows details of the cover assembly.
Figure 5:
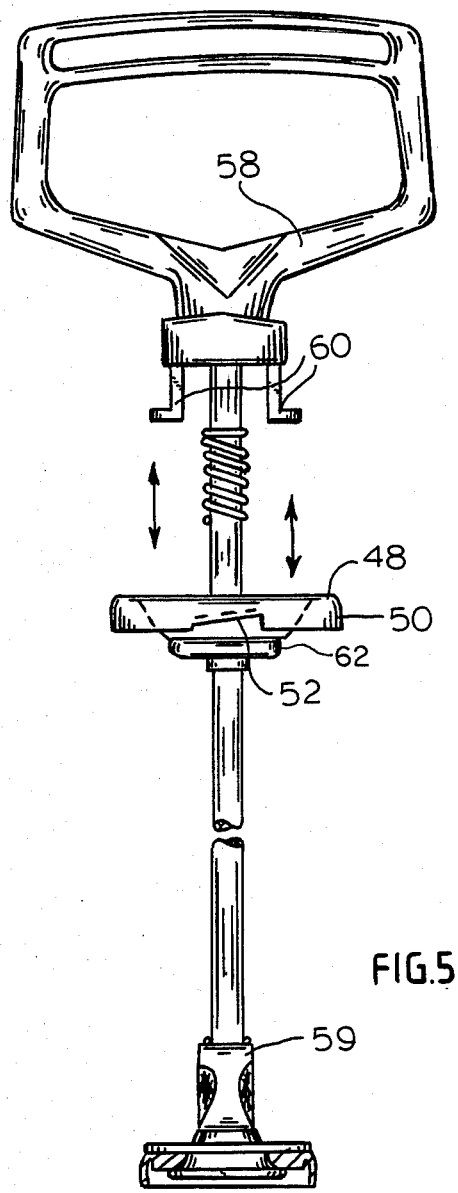
FIG. 5 shows details of the pump piston.
Figure 6:
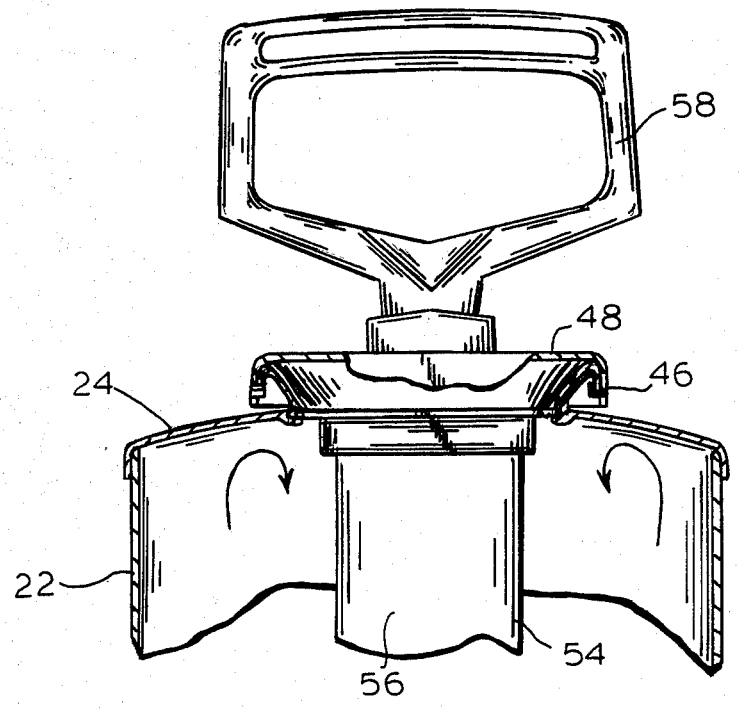
FIG. 6 shows the tank closed.

An air pump assembly 54 is mounted to the bottom of conical member 46 and it comprises a pipe 56 extending downward into the tank, and handle 58. Holes extend from the top of member 46 into pipe 56. The handle is attached to a piston 59 whereby a vertically reciprocating motion of the handle results in air being pumped into the tank. Handle 58 is provided with legs 60 for engaging member 46 as shown in FIG. 3 whereby the members may be rotated with respect to tank 12 by a corresponding motion of the handle. Adjacent to the top end of pipe 56 there is a ring 62 having an outer diameter which is larger than the diameter of the hole formed by inner flange 44.

The sprayer is operated as follows. After a suitable liquid is poured into the tank, the pump assembly is inserted into the tank and the closure is positioned over the funnel so that lips 52 and 54 of member 46 pass through notches 30 and 32 of flange 28. At this time, closure 14 rests on ring 62 with lips 52 and 54 being positioned adjacent to but just below upper notches 38. Now a clock-wise twist of the closure forces the lips to engage the cammed areas 34 and 36 and as the lips ride on these areas they force the cover to tighten to the tank by pressing down on the ring 62 so that a tight air seal is formed by the ring. This motion may be continued until the lips almost hit the lower extensions 40. These lower extensions are provided to insure that the closure is not tightened too much, and to lengthen the life of ring 62. Now the tank is closed and may be pressurized by activating the pump assembly.

Figure 7:
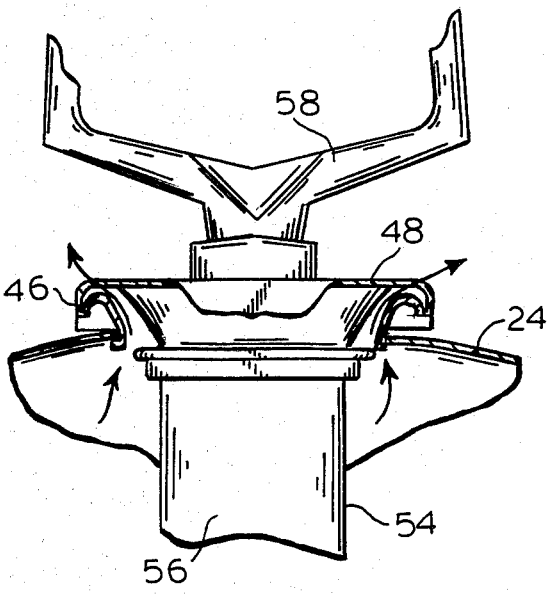
FIG. 7 shows the cover being removed from the tank.

Under normal conditions, i.e. when the tank is depressurized, opening of the tank takes place in the reverse order than the one described above. However, if the tank is opened while the tank is still under pressure, as soon as the seal is broken, air from the tank escapes as shown in FIG. 7. This forces the closure to turn counterclockwise as lips 52 and 54 ride on the cammed areas. However, this motion is stopped when the lips reach the upper extensions 38. Thus the upper extensions 38 are provided to prevent an explosive separation between the tank 12 and closure 14.

The components of the sprayer may be easily manufactured by standard methods well known in the art. Furthermore because of the invention's simplicity no assembly is required beyond affixing the pump assembly to the closure.

Numerous modifications may be made to the invention without departing from its scope as defined in the appended claims.

What is claimed is;

1. A sprayer for dispensing a liquid comprising:

a tank provided for holding said liquid and having a funnel-shaped neck with an upper flange and a circumferential wall extending downwardly from said upper flange, said wall having at least one bottom edge portion formed to gradually rise toward said flange to form a cammed surface;

a pump for generating air pressure within said tank;

a closure adapted to hold said pump and to form an air tight seal with said tank while the tank is pressurized by engaging said cammed surface;

means mounted on said neck and adapted to stop said closure from separating from said tank when said closure is removed while the tank is pressurized; and a nozzle for dischargine said liquid under pressure from said tank.

2. The sprayer of claim 1 wherein said funnel-shaped neck has an inner flange, and said closure has a sealing ring which is forced against said inner flange when the closure is closed.

3. The sprayer of claim 2 wherein said closure has a notch adapted to engage and follow said cammed surface.

4. The sprayer of claim 3 wherein said cammed surface comprises an extrusion extending downwards which is adapted to stop said notch from disengaging said cammed surface when said cover is opened while said tank is pressurized.

* * * * *